US007225851B2

(12) United States Patent
Schonbek et al.

(10) Patent No.: US 7,225,851 B2
(45) Date of Patent: Jun. 5, 2007

(54) METHODS AND APPARATUS FOR DISPLAYING DECORATIVE ORNAMENT CURTAINS

(75) Inventors: Andrew J. Schonbek, Plattsburgh, NY (US); Steven Lussier, Morrisonville, NY (US); Andrew Schuyler, Colchester, VT (US)

(73) Assignee: Schonbek Worldwide Lighting Inc., Plattsburgh, NY (US)

( * ) Notice: Subject to any disclaimer, the term of this patent is extended or adjusted under 35 U.S.C. 154(b) by 261 days.

(21) Appl. No.: 11/036,864

(22) Filed: Jan. 14, 2005

(65) Prior Publication Data

US 2006/0157207 A1 Jul. 20, 2006

(51) Int. Cl.
*A47H 23/05* (2006.01)

(52) U.S. Cl. ..... 160/332

(58) Field of Classification Search ..... 160/332, 160/184, 196.1, 166.1, 327, 368.1
See application file for complete search history.

(56) References Cited

U.S. PATENT DOCUMENTS

| | | | | | |
|---|---|---|---|---|---|
| 510,590 | A | * | 12/1893 | Dreyfus | 160/332 |
| 534,828 | A | * | 2/1895 | Hensel | 160/332 |
| 704,799 | A | * | 7/1902 | Hepburn et al. | 160/332 |
| 795,972 | A | * | 8/1905 | Harding | 160/396 |
| 822,431 | A | * | 6/1906 | Crawford | 160/332 |
| 1,016,211 | A | * | 1/1912 | Christopherson | 160/332 |
| 1,057,491 | A | * | 4/1913 | Morrison et al. | 160/332 |
| 1,133,966 | A | * | 3/1915 | Hoye | 160/332 |
| 1,472,933 | A | * | 11/1923 | Paszkiewicz | 160/332 |
| 1,634,312 | A | * | 7/1927 | Zecchino | 160/332 |
| 1,758,600 | A | * | 5/1930 | Grassi | 160/332 |
| 1,782,339 | A | * | 11/1930 | Campobasso | 160/332 |
| 2,255,714 | A | * | 9/1941 | Rodelli | 160/332 |
| 2,884,054 | A | * | 4/1959 | Bryant | 160/332 |
| 3,456,711 | A | * | 7/1969 | Spencer | 160/332 |
| 3,629,571 | A | | 12/1971 | Schonbek | 240/153 |
| 3,967,129 | A | * | 6/1976 | Winkler | 250/517.1 |
| 3,977,458 | A | * | 8/1976 | Kuen | 160/332 |
| 4,719,957 | A | * | 1/1988 | Strelnieks | 160/332 |
| 4,736,608 | A | * | 4/1988 | Laws et al. | 72/200 |
| 4,878,532 | A | * | 11/1989 | Strelnieks | 160/332 |

(Continued)

OTHER PUBLICATIONS

Zicoli Light Collection © 2003; The Contemporary Collection, p. 11.

(Continued)

*Primary Examiner*—David Purol
(74) *Attorney, Agent, or Firm*—Heslin Rothenberg Farley & Mesiti P.C.; John Pietrangelo

(57) ABSTRACT

When displaying decorative ornaments in vertical chains, that is, as ornament curtains, for example, in light fixtures, gaps or voids between the ornaments can detract from the overall visual appeal. Methods and apparatus of the present invention minimize the gaps and voids in an ornament display to provide a denser display of ornaments than the existing art. According to aspects of the invention, the denser ornament display is achieved by mounting ornament chains in gallery rings that suspend the ornament chains in staggered relationship either in multiple planes or within the same plane whereby the ornaments fill the gaps and voids in the visual field of the viewer. The invention also includes improved gallery rings and ornament chains that are adapted to be mounted to the improved gallery rings. Aspects of the invention may be used in many types of ornamental light fixtures, such as, chandeliers.

47 Claims, 11 Drawing Sheets

U.S. PATENT DOCUMENTS

| | | | | |
|---|---|---|---|---|
| 5,104,082 | A | 4/1992 | Bayer | 248/303 |
| 5,109,325 | A | 4/1992 | Bayer et al. | 362/433 |
| 5,116,009 | A | 5/1992 | Bayer | 248/303 |
| 5,144,541 | A | 9/1992 | Schonbek | 362/405 |
| 5,241,460 | A | 8/1993 | Schonbek | 362/405 |
| 5,285,364 | A | 2/1994 | Bayer | 362/405 |
| 5,573,330 | A | 11/1996 | Lucas | 362/405 |
| D397,494 | S | 8/1998 | Bayer et al. | D26/154 |
| 5,906,430 | A | 5/1999 | Bayer | 362/404 |
| 5,921,668 | A | 7/1999 | Bayer | 362/404 |

OTHER PUBLICATIONS

Swarovski © 2002; Crystal Perspectives; Crystal Net Pinning, p. 45.
Schonbek "Strass" Catalog; pp. 10, 11, 12, 22, 23, 24, 24, published 1970.
Schonbek Catalog, "Jubilee" cover; pp. 300, 301, published Jun. 20, 2002.
Schonbek Fixture No. 5887; Apr. 20, 1989; "Horizontally-Mounted Ornament Fixture".

* cited by examiner

METHODS AND APPARATUS FOR DISPLAYING DECORATIVE ORNAMENT CURTAINS

TECHNICAL FIELD

The present invention concerns methods and apparatus for supporting decorative ornaments, for example, ornamental crystals. Specifically, the present invention concerns methods and apparatus for supporting decorative ornaments in decorative ornamental curtains while minimizing undesirable gaps and voids between ornaments, for example, for use in light fixtures, such as chandeliers.

BACKGROUND INFORMATION

In the construction of ornamental lighting fixtures, such as chandeliers, it is common to incorporate vertical "curtains" of decorative ornaments. These curtains are typically are made from "chains" of ornaments, for example, chains of suspended octagonal crystals. The most widely used and cost effective crystal element used in the construction of crystal chandeliers is the 14-millimeter (mm) octagon. For example, the 14-mm octagon is the preferred ornament used for candle-to-candle swag chains in traditional chandeliers, vertical curtain chains for contemporary fixture designs, and in a variety of other common crystal configurations.

Spherical facetted beads are widely used components in the jewelry industry, and are sometimes used in the fixture industry. Spherical faceted beads are typically available in a variety of sizes, shapes, and colors. Historically, spherical faceted beads have had some limited use in the construction of chandeliers. More recently, the use of spherical faceted beads has increased; particularly, these beads are used to line the arms and scrolls of traditional chandeliers and in candle-to-candle swag chains. There have also been some attempts to use such jewelry beads to create crystal curtains.

The 14-mm crystal octagon ornaments became the preferred component for use in crystal curtain designs with the invention by Arnold Schonbek of the so called "bow tie connector," for example, as described in U.S. Pat. No. 3,629,571. The Schonbek bow tie connector provides the advantage of preventing ornament chains from twisting. By preventing twisting, the designer can create the visual effect of a continuous crystal surface, for example, by arranging octagons broad side out and adjacent to one another. Prior to the introduction of the Schonbek connector, interlocking wire loops were used to link ornamental crystals in chains. Not only did these interlocking wire loops vary in length, but wire loops also allowed the individual crystals to undesirably rotate and twist. As a result, when using wire lops, the orientation of ornaments one-to-another was often compromised. For example, the resulting crystal surface was typically interrupted by many openings and gaps due to the imprecision of the positioning of the ornaments, for example, the octagonal ornaments.

Even with the use and broad acceptance of the Schonbek connector, the resulting crystal curtains that used these connectors often lacked "density," that is, often lacked a uniform continuous ornament display. Among other things, this lack of density is primarily due to the gaps or discontinuities that could appear between adjacent ornaments. This lack of density that is typical of prior art ornament arrangements is clearly shown in FIG. 1.

As shown in FIG. 1, an arrangement 10 of octagonal crystals 12 connected by the connectors 14 disclosed in U.S. Pat. No. 3,629,571 typically resulted in undesirable gaps 16 between crystals 12. Among other things, these gaps 16 reduce the visually density of the display and introduce unsightly views into the interior of the chandelier.

An improvement in the appearance of lighting fixtures was realized in another innovation of Arnold Schonbek. As shown in FIG. 2A, Mr. Schonbek introduced a crystal support arrangement 20 including a specially designed metal support ring 22. Support ring 22 functions to raise every other octagon chain 24 and position the octagon crystals 26 in chains 24 in an interlocking arrangement with octagonal crystals 26 in adjacent crystal chains 28. A similar prior art interlocking arrangement 30 is shown in FIG. 2B having ring 32 and crystal chains 34 and 38. The arrangement shown in FIG. 2B is typical of the ornament mountings in chandeliers provided by A. Schonbek & Co. Inc. (now affiliated with Schonbek Worldwide Lighting Inc. of Plattsburgh, N.Y.) under the trade name "Mirabelle." As shown in FIGS. 2A and 2B, these crystal arrangements have the effect of significantly reducing the size of the gaps 25 and 35, respectively, between the octagonal crystals.

Though an improvement in the art, the arrangements shown in FIGS. 2A and 2B are still far from ideal. For example, undesirable gaps 25 and 35 are still provided between the chains 24 and 28 and chains 34 and 38, respectively. In addition, these arrangements shown in FIGS. 2A and 2B inherently required the exposure of horizontal structures, that is, the support rings 22 and 32, having no crystal ornaments. These structures typically are provided to have a height or thickness sufficient to raise every other chain into the interlocking position. In many ornamental fixture designs this banding (which is sometimes referred to as "vertical banding") introduced an unwelcome visual element.

One prior art ornament arrangement that reduces the required size of the vertical banding is shown in FIG. 3. In this prior art arrangement 40, interlocking of octagonal crystals can be provided by suspending the adjacent an intermediate crystal chain 48 between adjacent chains 44 from an appropriately longer wire hook 42 suspended from a gallery ring 43. However, arrangement 40 is also undesirable because it is characterized by especially unsightly gaps 45 at the top of the alternating chains 44, 48.

Another prior art improvement in the design of chandeliers having crystal curtains is provided with the development of the "pocket gallery", for example, as disclosed in U.S. Pat. No. 5,144,541. The pocket gallery, or the gallery plate having apertures or "pockets" for retaining ornaments, reduced or eliminated the disturbing appearance of vertical banding associated with a standing gallery ring while precisely positioning adjacent chains in relation to one another. However, the clean, metal-free appearance of the pocket gallery design is gained at the expense of a less dense curtain, since the individual octagons are typically arrayed along side one another, once again opening up square-shaped gaps, for example, similar to gaps 16 of FIG. 1.

Attempts have been made by artisans in the field to use facetted bead chains to create crystal curtains. However, these designs have generally been unsatisfactory for a number of reasons. For example, given their spherical shape, facetted beads are not a cost effective means of covering an ornamental surface. Furthermore, satisfactory methods for precisely positioning of such beads did not exist in the art.

Some attempts have been made to use square crystal chains, as shown in FIGS. 4A and 4B. FIG. 4A shows a front elevation view of an ornament arrangement 50 having a plurality of vertical ornament chains 52 comprising square ornaments 54. FIG. 4B is a plan view of a section of gallery plate 56 used in arrangement 50. Chains 52 are mounted in a gallery plate 56 having apertures 58 that retain ornaments 54 to suspend chains 52. Though arrangement 50 produces a dense crystal curtain, the disadvantage of arrangement 50 is that square crystals are not preferred; specifically, the faceting pattern of square crystals inherently reduces the prismatic effect of the appearance of the fixture.

Another prior art attempt to provide a dense, vertically hanging, crystal curtain is provided by the prior art arrangement shown in FIGS. 5A and 5B. FIG. 5A shows a front elevation view of an ornament arrangement 60 having a plurality of vertical ornament chains 62 comprising octagonal ornaments 64. FIG. 5B is a plan view of a section of gallery plate 66 used in arrangement 60. Prior art arrangement 60 increased the density of the crystal presentation with the addition of glass rods 68 suspended in apertures 68 in gallery plate 66 between adjacent octagon chains 64 suspended in apertures 69 in gallery plate 66. However, since the octagons 64 and glass rods 68 do not interlock, undesirable gaps 65 are left in the "curtain" of ornaments. Notwithstanding this disadvantage, in arrangement 60, the optical effect of the light in the glass rods 68 provides the desirable effect of drawing the eye of the viewer away from the fixture's internal components, for example, away from a chandelier's internal components. Thus, in this aspect, prior art arrangement 60 provides some improvement over arrangements that came before it.

However, clearly, these, and other, examples of prior art crystal mounting arrangements are characterized by undesirable gaps between ornaments. These gaps not only interrupt the desired uniform continuous display preferred in lighting fixtures, but these gaps may also undesirably expose internal components of the fixture, for example, internal structural components, that may be unsightly or simply interfere with the desired presentation intended by the designer of the fixture. These and other disadvantages of the prior art are overcome by aspects of the present invention.

SUMMARY OF THE INVENTION

Aspects of the invention allow for the construction of dense ornamental crystal curtains, for example, extremely dense ornamental crystal curtains, compared to the prior art. In addition, aspects of the invention provide for the introduction of blended color patterns in the crystal curtains, for example, complex blended color patters. Aspects of the invention provide the designer with numerous exciting aesthetic design possibilities.

Aspects of the invention combine two unlike elements in adjacent interlocking vertical curtain chains. Other aspects of the invention combine like or unlike elements in adjacent interlocking vertical curtain chains where every other chain is recessed in relation to the adjacent chain.

One aspect of the invention is a method of mounting ornaments, the method including suspending a plurality of ornament chains in a first vertical plane, the ornament chains comprising a plurality of spaced first ornamental elements; and suspending at least one second ornamental element in a second vertical plane, laterally spaced from the first vertical plane, wherein the at least one second ornamental element is positioned in staggered relationship with the ornament chains. According to one aspect of the invention, the second vertical plane may be positioned in front of or behind the first vertical plane.

Another aspect of the invention is an ornament arrangement including at least one support structure adapted to support a plurality of ornamental elements; a plurality of ornament chains comprising a plurality of first ornamental elements, the first ornament chains mounted to the at least one support structure in a first vertical plane; and at least one second ornamental element mounted to the at least one support structure in a second vertical plane, laterally spaced from the first vertical plane, and positioned in staggered relationship with the plurality of first ornament chains. In one aspect of the invention, the at least one second ornamental element comprises at least one of an individual ornament and an ornament chain comprising a plurality of ornaments.

Another aspect of the invention is a support structure for supporting ornaments, the support structure including a plurality of first apertures, the first apertures positioned in spaced relationship and defining a first vertical plane, and the first apertures adapted to support a plurality of first ornaments; and a plurality of second apertures, the second apertures positioned in spaced relationship and defining a second vertical plane, laterally spaced from the first vertical plane, the second apertures positioned in staggered relationship with the first apertures, and the second apertures adapted to support a plurality of second ornaments in staggered relationship with the plurality of first ornaments. In one aspect of the invention, the support structure may comprise a gallery plate or ring.

A further aspect of the invention is an ornament arrangement including an elongated support element; a plurality of ornaments mounted to the support element; a plurality of spacers mounted to the support element between the plurality of ornaments; and means for mounting the ornamental arrangement to a support structure wherein the ornament arrangement suspends vertically from the support structure. In one aspect of the invention, the support element may comprise a wire or a rod.

A further aspect of the invention is a method of mounting ornaments, the method including suspending a plurality of first ornament chains comprising a plurality of first ornaments having a first nominal size in a vertical plane, the plurality of first ornaments positioned in spaced relationship; and suspending a plurality of second ornament chains comprising a plurality of second ornaments having a second nominal size, different from the first nominal size, in substantially the same vertical plane, and wherein the plurality of second ornament chains are positioned in staggered relationship with the first ornament chains. In one aspect of the invention, the second nominal size is less than the first nominal size.

An even further aspect of the invention is an ornament arrangement including a at least one support structure adapted to support a plurality of ornamental elements; a plurality of ornament chains comprising a plurality of first ornaments having a first nominal size and positioned in spaced relationship, the plurality of first ornament chains mounted to the at least one support structure in a vertical plane; and a plurality of second ornament chains comprising a plurality of second ornaments having a second nominal size, different from the first nominal size, the plurality of second ornament chains positioned in staggered relationship with the first ornament chains and mounted to the at least one support structure in substantially the same vertical plane. In one aspect of the invention, the plurality of second ornaments may be positioned at different elevations than the plurality of first ornaments. In one aspect of the invention, the support structure may comprise a gallery plate or ring.

These and other aspects of the present invention provide improvements over the prior art, specifically, improvements in ornament curtain design that minimizes the appearance of gaps and voids between ornaments. In addition, aspects of the present invention provide the ornamental fixture designer with a vehicle for providing enhanced visual effect that heretofore was unavailable. These advantages and improvements will become more readily apparent upon review of the myriad aspects of the present invention illustrated in and described with respect to the enclosed drawings.

BRIEF DESCRIPTION OF THE DRAWINGS

The subject matter, which is regarded as the invention, is particularly pointed out and distinctly claimed in the claims at the conclusion of the specification. The foregoing and other objects, features, and advantages of the invention will be readily understood from the following detailed description of aspects of the invention taken in conjunction with the accompanying drawings in which:

DETAILED DESCRIPTION OF ASPECTS OF THE INVENTION

Figure 1:
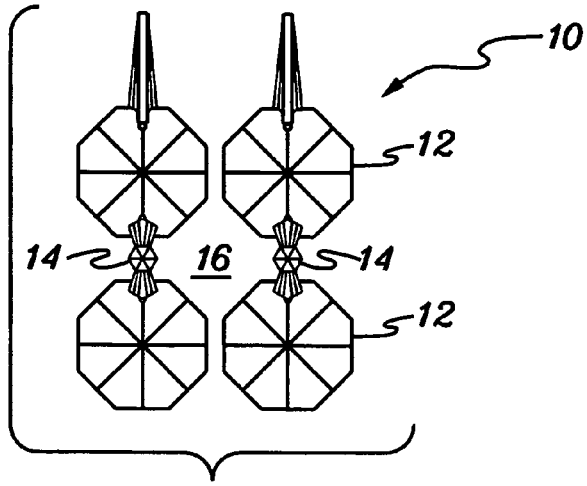
FIG. 1 an elevation view of a prior art ornament arrangement over which aspects of the present invention are improvements.
Figures 2A, 2B:
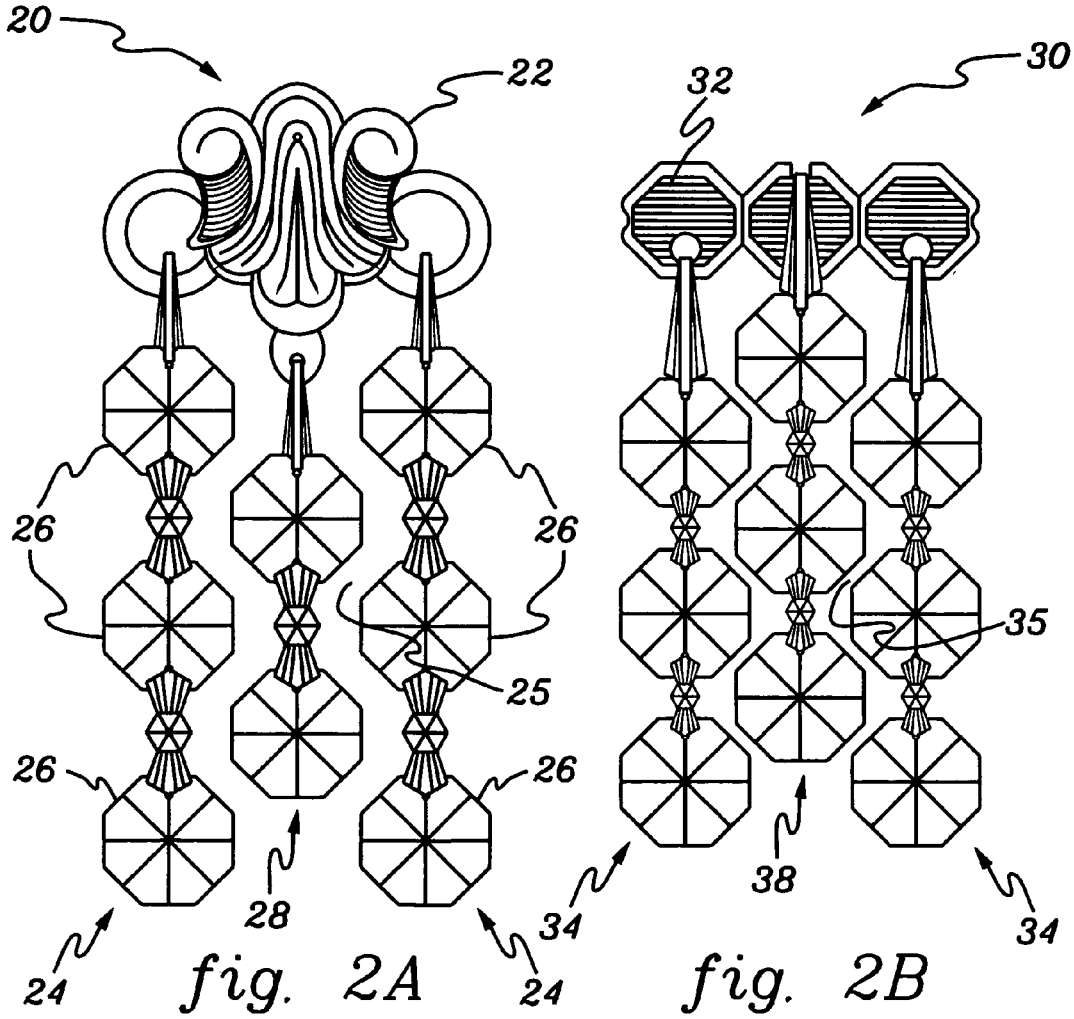
FIGS. 2A and 2B are elevation views of two other prior art ornament arrangement over which aspects of the present invention are improvements.
Figure 3:
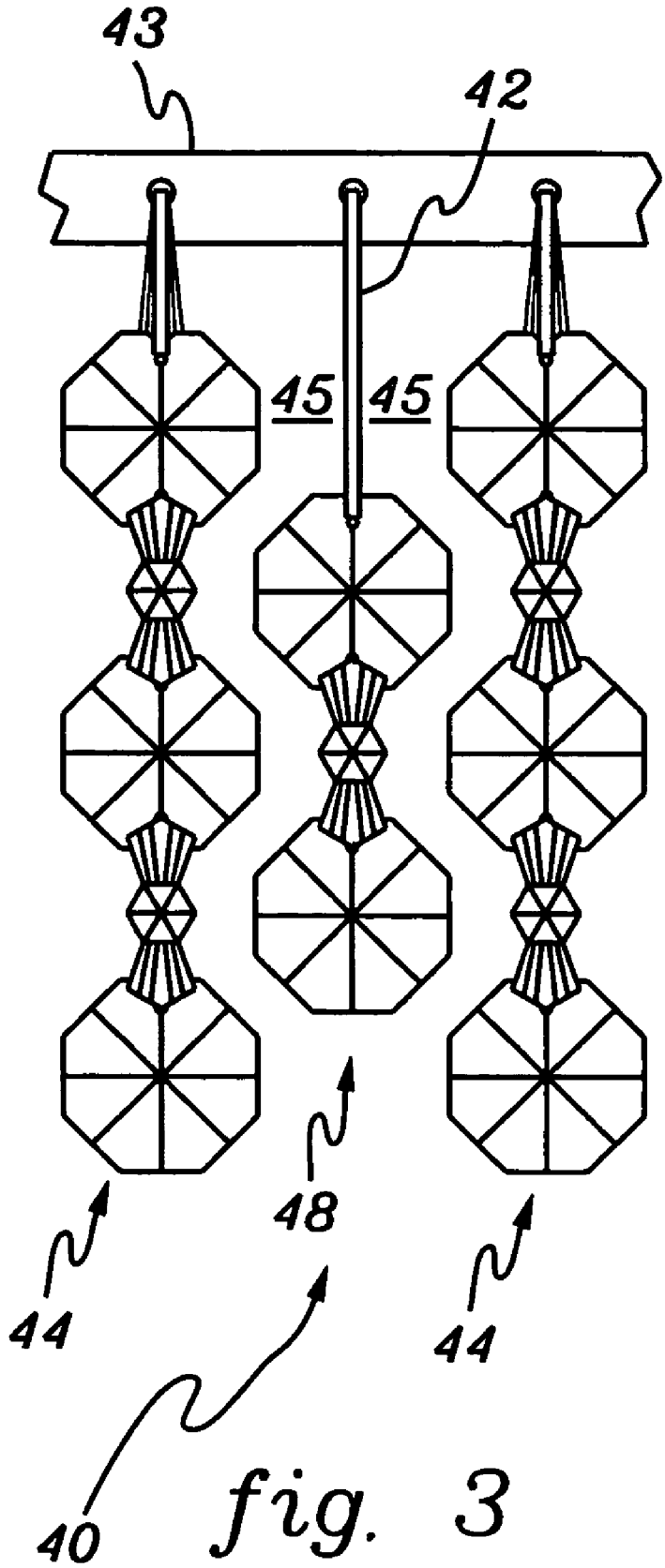
FIG. 3 is an elevation view of another prior art ornament arrangement over which aspects of the present invention are improvements.
Figure 4B:
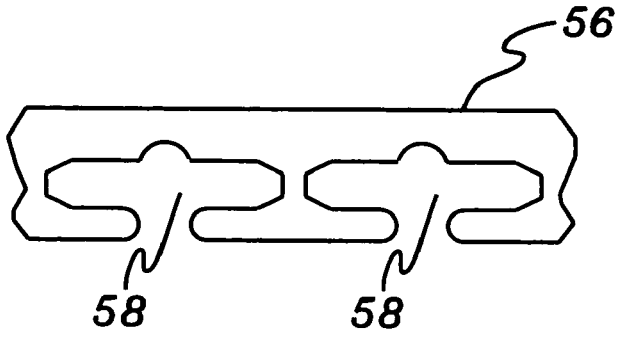
FIG. 4B is a plan view of a gallery plate used in the prior art ornament arrangement shown in FIG. 4A.
Figure 4A:
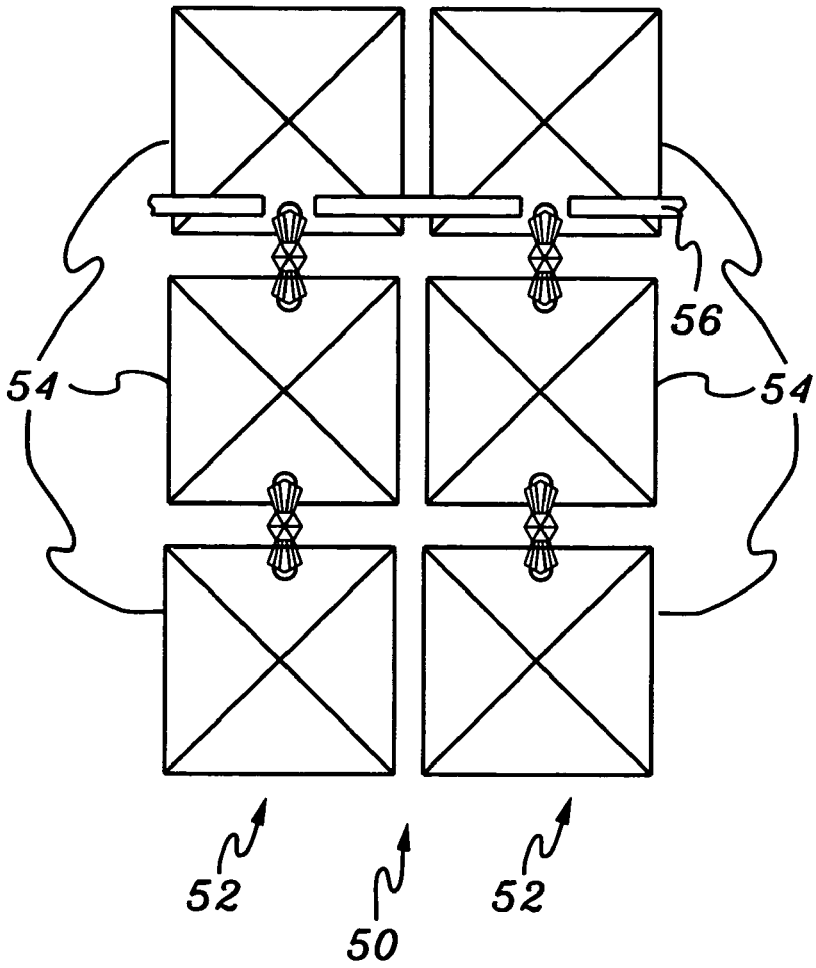
FIG. 4A is an elevation view of another prior art ornament arrangement over which aspects of the present invention are improvements.
Figure 5B:
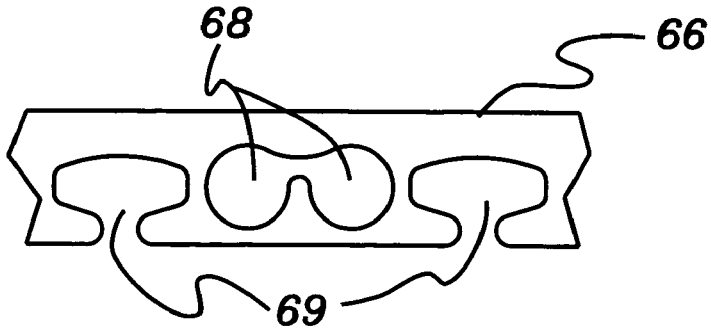
FIG. 5B is a plan view of a gallery plate used in the prior art ornament arrangement shown in FIG. 5A.
Figure 5A:
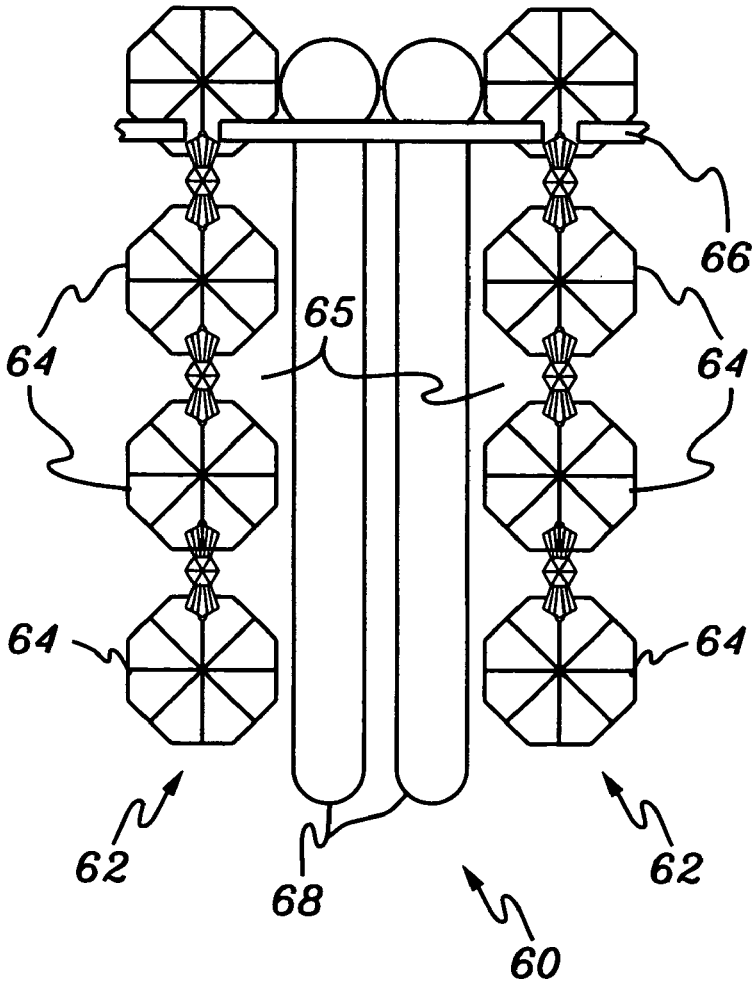
FIG. 5A is an elevation view of still another prior art ornament arrangement over which aspects of the present invention are improvements.
Figure 6A:
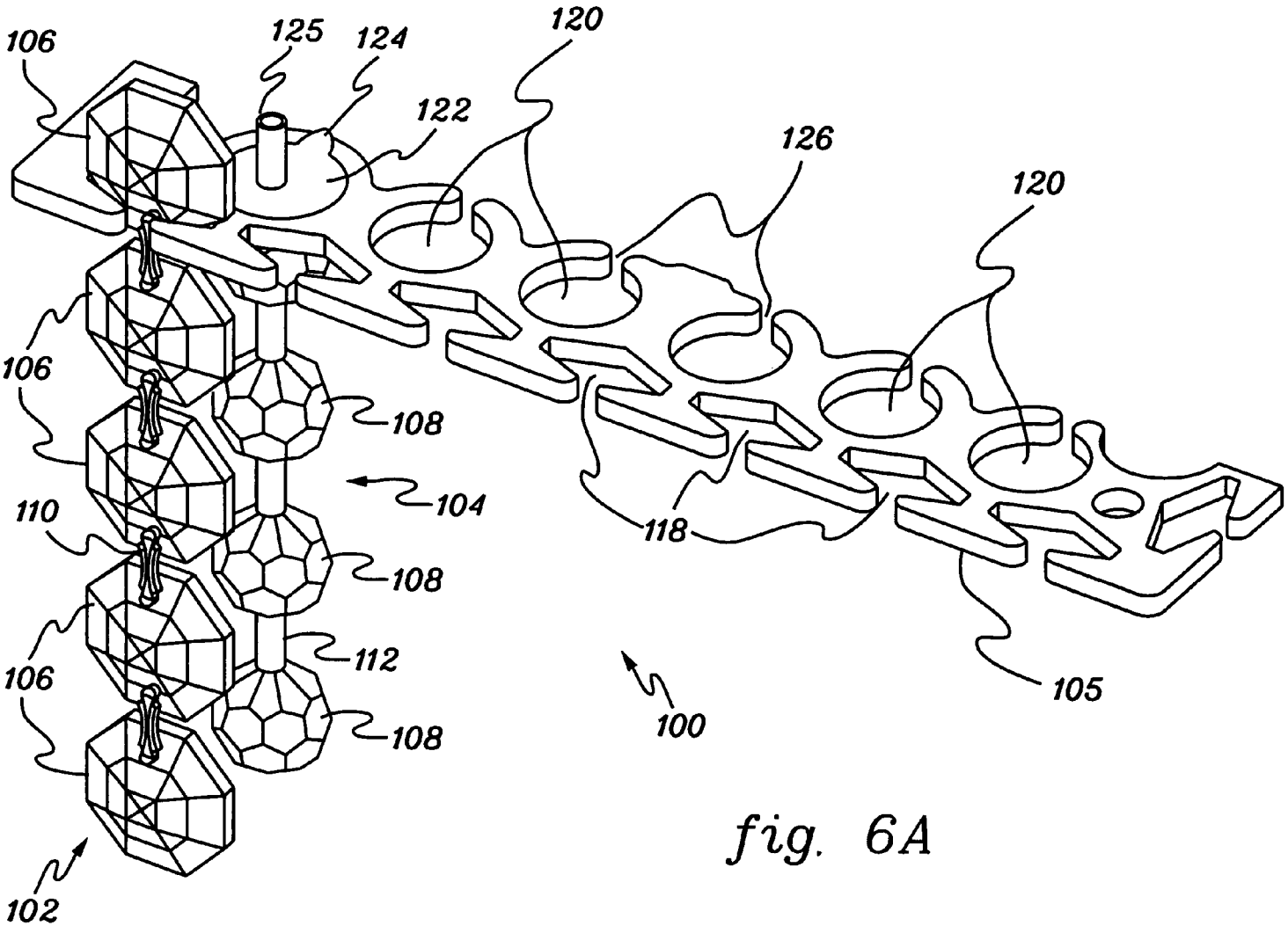
FIG. 6A is perspective view of an ornament arrangement according to one aspect of the present invention.
Figure 6C:
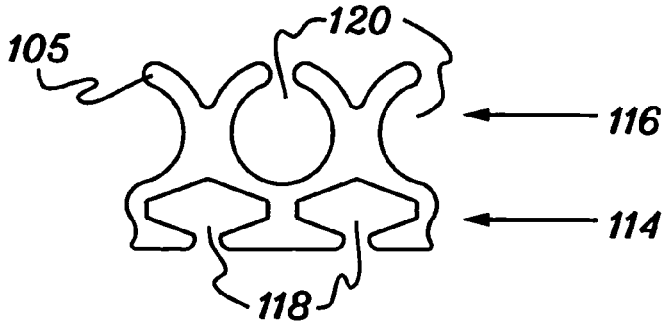
FIG. 6C is a partial plan view of a gallery plate used in the arrangement shown in FIGS. 6A and 6B according to one aspect of the invention.
Figure 6B:
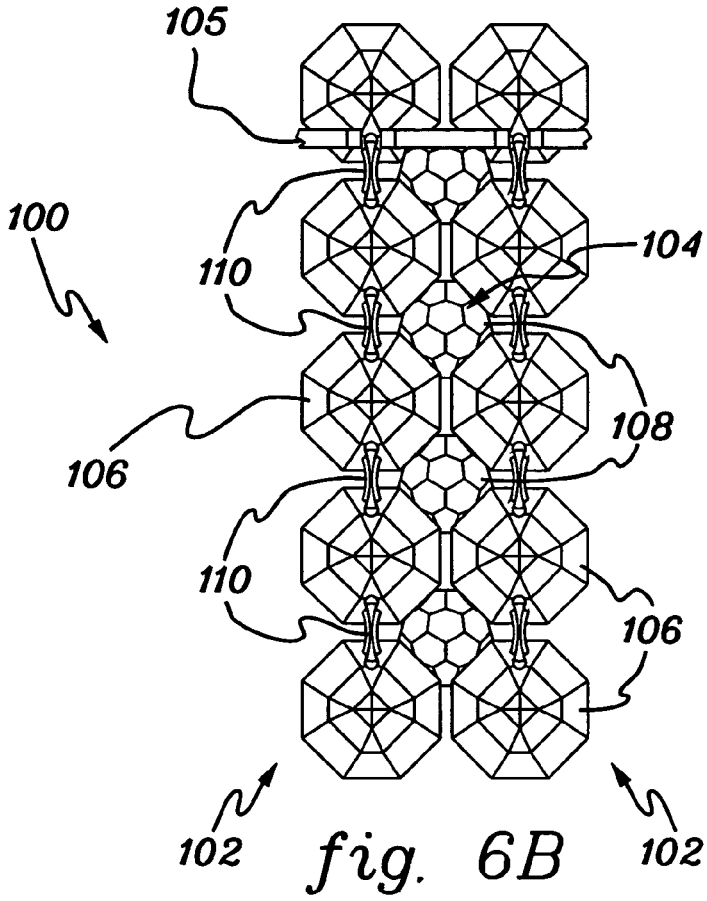
FIG. 6B is a partial front elevation view of the aspect of the invention shown in FIG. 6A according to one aspect of the invention.
Figure 6D:
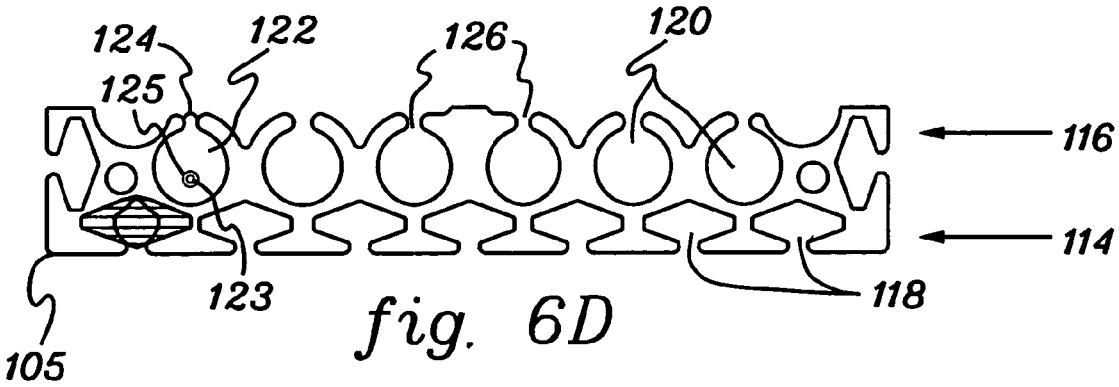
FIG. 6D is a top view of the arrangement shown in FIG. 6A according to one aspect of the invention.

Aspects of the invention are illustrated in FIGS. 6A through 6D. FIG. 6A is perspective view of an ornament arrangement or fixture 100 according to one aspect of the present invention. FIG. 6B is a partial front elevation view of the ornament arrangement 100 shown in FIG. 6A. According to aspects of the invention, arrangement 100 includes a plurality of ornament crystal chains 102 and 104 suspended from a gallery plate 105. In one aspect of the invention, chain 104 may comprise an ornamental element, such as, an individual crystal or rod. Arrangement 100 shown in FIG. 6A illustrates only a single ornament chain 102 and a single ornament chain 104 to facilitate illustration of aspects of the invention. However, typically, aspects of the invention include a plurality of ornament chains 102 and a plurality of ornament chains 104. FIG. 6C is a partial plan view of gallery plate 105 from which ornament chains 102 and 104 may be suspended. FIG. 6D is a top view of arrangement 100 shown in FIG. 6A.

According to one aspect of the invention, gallery plate 105 (and any gallery plate or ring disclosed herein) may comprise any type of support structure, for example, a support structure adapted for suspending ornaments. Gallery plate 105 may be any conventional shaped plate, including a circular ring or rectangular plate, as is conventional. Gallery plate 105 may be metallic or non-metallic, for example, iron, steel, stainless steel, aluminum, titanium, nickel, magnesium, brass, bronze, copper, silver, gold, or any other structural or ornamental metal. In one aspect, gallery plate 105 may be made from plastic, for example, a polyamide (PA), for example, nylon; a polyethylene (PE); a polypropylene (PP); a polyester (PE); a polytetraflouroethylene (PTFE); an acrylonitrile butadiene styrene (ABS); a polycarbonate (PC); or a polyvinylchloride (PVC), among other plastics. Gallery plate 105 may be fabricated by conventional means, for instance, cut from plate (for example, punched, milled, laser-cut, water-jet cut, EDM-cut, and the like), forged, cast, welded, and the like.

As shown in FIGS. 6A and 6B, ornament chains 102 and 104 include ornaments or ornamental elements 106 and 108, respectively. According to aspects of the invention, ornament chains 102 and 104 may comprise any one of a myriad of ornaments or ornamental elements and related ornament hardware, for example, spacers and connectors. For instance, according to aspects of the present invention, ornaments or ornamental elements 106 and 108, and all ornaments discussed herein, may comprise any type of perforated bead, stone, crystal, or the like that may be used in decorative fixtures. For example, according to one aspect of the invention ornaments or ornamental elements 106 and 108, and any ornaments mentioned herein, may comprise any type of faceted or non-faceted (that is, smooth) shape, for example, spheres, cubes, cones, bars, tubes, rods, prisms, pears and the like. Though aspects of the invention typically include perforated ornaments, it is to be understood that perforated ornaments may also include non-perforated ornaments having appendages, for example, wire loops or hooks, by which the non-perforated ornament may be suspended. Ornaments 106 and 108, and any ornaments mentioned herein, may be made from glass, plastic, metal, stone, or any other conventional material from which ornamental beads and crystals are typically made. Ornaments 106 and 108, and any ornaments mentioned herein, may also comprise perforated gems or gems mounted on perforated mountings, for example, diamonds, rubies, sapphires, opals, and the like. Ornaments 106 and 108, and any ornaments mentioned herein, may be made from a transparent, translucent, or opaque material, for example, colored glass. The significance of the colors of the ornaments 106, 108 used, for example, the significance of the color of glass ornaments used, with aspects of the invention will be discussed further below. In one aspect of the invention, ornaments 106 and 108, and any ornaments mentioned herein, may also comprise illuminated ornaments, such as, lights or light-emitting diodes (LEDs). Though in the aspect of the invention shown in FIGS. 6A and 6B, ornament chain 102 includes 5 ornaments 106 and ornament chain 104 includes 4 ornaments 108, in aspects of the invention, ornament chain 102 may include one or more ornaments 106, typically two or more ornaments 106 and ornament chain 104 may include one or more ornaments 108, typically two or more ornaments 108. For example, in one aspect of the invention, ornament chain 102 may include 10 or more ornaments 106 and ornament chain 104 may include 10 or more ornaments 108.

Regardless of the myriad of ornaments that may be used for the present invention, in the aspect of the invention shown in FIGS. 6A, 6B, and 6D, ornaments 106 comprise conventional 14-mm octagonal glass crystals and ornaments 108 comprise conventional spherical faceted glass beads. For example, the 14-mm octagonal glass crystals may be crystals provided by D. Swarovski & Co. of Wattens, Austria, or their equivalent; and the spherical faceted glass beads may be beads provided by D. Swarovski & Co., or their equivalent. In one aspect, ornaments 108 may comprise 14-mm octagonal glass crystals having at least two apertures, for example, at least two diametrically opposed apertures through which connecting means may be inserted. As shown, ornaments 106 may be suspended by means of a plurality of connectors 110 that engage the perforations in the octagonal crystals. For example, connectors 110 may comprise a plurality of bow tie connectors as disclosed in U.S. Pat. No. 3,629,571, or in copending U.S. application Ser. No. 10/774,264 filed on Feb. 5, 2004 (attorney ref. 2350.422), though in aspects of the invention other conventional ornament connectors, such as wire connectors, may be used. In addition connectors 110 may be loose connectors or connectors somehow integrated into ornament 106.

In the aspect shown in FIGS. 6A and 6B, ornaments 108 are suspended in an ornament chain 104 according to another aspect of the invention. In one aspect, ornament chain 104 may be referred to as an ornament "bead skewer." In one aspect ornament chain 104 may be oriented in a vertical direction, for example, suspended from gallery ring 105 from above. That is, in one aspect of the invention, ornaments 108 may include through holes, for example, through holes passing through the center of the ornament 108, through which a support element, for example, a wire or a rod, (not shown) may pass to engage the plurality of ornaments 108 and from which ornament chain 104 may be suspended, for example, suspended from gallery plate 105. In the aspect of the invention shown in FIGS. 6A and 6B, ornament chain 104 may also include one or more ornament spacers 112. In this aspect of the invention, spacers 112 may comprise small tubes, for example, small metallic or non-metallic tubes, through which the support element which mounts ornaments 108 to chain 104 passes. In one aspect, spacers 112 locate ornaments 108 on ornament chain 104 whereby, when suspended, ornaments 108 are positioned, for example, precisely positioned, at elevations between ornaments 106 on ornament chain 102, for example, substantially midway between adjacent ornaments 106 on ornament chain 102, as shown in FIG. 6B. In one aspect of the invention, ornaments 108 may be positioned on chain 104 whereby ornaments 108 are located at an elevation anywhere between adjacent ornaments 106. In another aspect of the invention, the lower-most ornament 108 in ornament chain 104 may be suspended from the support element, for example, a wire or rod, (not shown) passing through ornaments 108 by a conventional obstruction, for example, a flared or crimped ferrule attached to the wire or rod. The support element may comprise an elongated support element, such as, an elongated wire or narrow rod. As shown in FIGS. 6A and 6B, ornament chains 6A and 68 may typically be suspended vertically from gallery plate 105.

As shown in FIGS. 6A and 6B, ornament chains 102 and 104 may be suspended from gallery plate 105. In one aspect of the invention gallery plate 105 may be adapted by any means for supporting ornament chains 102 and 104, for example, for supporting ornament chains 102 and 104 in staggered relationship with each other. According to one aspect of the invention, "staggered relationship" means that ornament chains 102 and 104 are positioned whereby the centerlines or axes of ornament chains 102 and 104 do not align, for example, the centerlines or axes of ornament chains 102 and 104 when viewed in a front elevation view, for example, as shown in FIG. 6B, do not coincide, but are at least partially offset. In one aspect of the invention, staggered relationship means that when viewed in a front elevation view, ornaments 108 of ornament chain 104 at least partially fill the space between ornaments 106 on ornament chain 102. In one aspect of the invention, staggered relationship means that when viewed in a front elevation view, ornaments 108 of ornament chain 104 substantially fill the space between ornaments 106 on ornament chain 102, for example, fill the space by at least 50% or more, or even 90% or more. In one aspect of the invention, when viewed in a front elevation view, ornaments 108 of ornament chain 104 sufficiently fill the space between ornaments 106 on ornament chain 102 whereby little or no space is visible between ornaments, for example, whereby substantially no internal components of the fixture can be seen.

As shown most clearly in FIGS. 6A and 6C, according to one aspect of the invention, gallery plate 105 having at least two rows 114 and 116 of apertures 118 and 120, respectively, may be provided. As shown in FIG. 6A, according to aspects of the invention, apertures 118 and 120 in gallery plate 105 may be adapted to support ornament chains 102 and 104; for instance, at least one of apertures 118 and 120 may be adapted to retain an ornament 106 or an ornament 108. For example, as shown in FIGS. 6C and 6D, apertures 118 may be shaped to conform to the shape of the ornament being supported, specifically, aperture 118 may be "diamond shaped" to conform to the diamond-shaped cross-section of octagon ornament 106. Similarly, aperture 118 may be circular in shape to conform to the shape of bead ornament 108. Also, apertures 120 in gallery plate 105 may be similarly shaped to conform to the shape of the ornament being supported.

Figure 7:
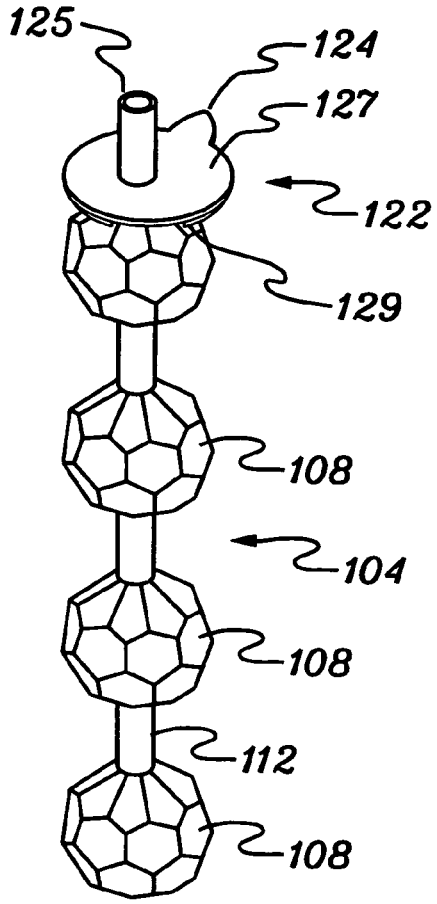
FIG. 7 is a perspective view of an ornament chain according to one aspect of the invention.
Figure 7A:
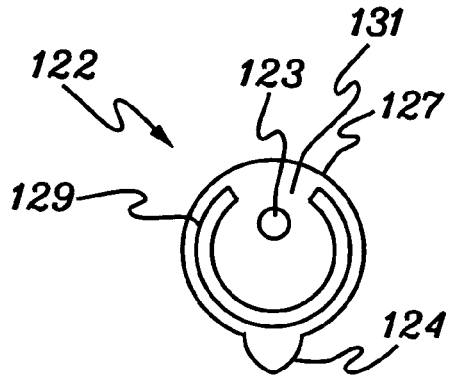
FIG. 7A is a bottom view of the mounting cap shown in FIG. 7.

Though in one aspect of the invention ornament chains 102 and 104 may be suspended from gallery plate 105 by any conventional means, in one aspect, as shown in FIGS. 6A and 6D, at least one of the ornament chains 102 and 104 may be supported in gallery plate 105 by means of a mounting cap or "skewer end cap" 122. A perspective view of ornament chain 104 having mounting cap 122 is shown in FIG. 7. As shown, aperture 120 and mounting cap 122 may be circular in shape, but according to aspects of the invention, aperture 120 and mounting cap 122 may assume any shape, including oval, triangular, square, and rectangular, that are adapted to support ornament chain 104. FIG. 7A is a bottom view of mounting cap 122 shown in FIG. 7. In another aspect of the invention, the elongated support element, for example, a wire or rod, may be mounted directly to gallery plate 105, for example, by means of mechanical fasteners.

Mounting cap 122 may be adapted to engage aperture 120 whereby ornament chain 104 is supported on gallery plate 105. As shown in FIGS. 7 and 7A, according to one aspect, mounting cap 122 may comprise a circular disk 127 having a larger dimension, for example, a larger diameter, than aperture 120, and an annular ring 129 mounted beneath disk 127 having a smaller dimension, for example, a smaller diameter, than aperture 120. In one aspect, annular ring 129 may comprise a circular pad or boss beneath disk 127. In this aspect of the invention, the interaction of annular ring 129 and aperture 120 positions mounting cap 122 in aperture 120 while mounting cap 122 is supported on gallery plate 105 by circular disk 127. In one aspect of the invention, circular disk 127 of mounting cap 122 may include a beveled edge that interacts with a complementary beveled edge in aperture 120 (for example, a countersunk hole). In another aspect of the invention, aperture 120 may include a recessed lip or rim (for example, a counter bored hole) that is adapted to receive circular disk 127, with or without annular ring 129. According to one aspect of the invention annular ring 129 may be discontinuous, for example, annular ring 129 may include a gap 131 (see FIG. 7A) adapted to minimize or prevent interference with ornament 108, especially, when ornament chain 104 is offset or biased when mounted to ornament cap 122 (as will be discussed below).

Ornament chain 104 may be attached to mounting cap 122 or to gallery plate 105 by conventional means. For example, in one aspect, the wire or rod (not shown) supporting ornament chain 104 may be attached to mounting cap 122 or plate 105 by welding or mechanical fasteners. In another aspect, as shown in FIGS. 6D and 7A, the wire or rod supporting ornament chain 104 may pass through a hole 123 in mounting cap 122 or in plate 105 and a ferrule 125 may be attached to the wire or rod, for example, by crimping, to suspend the ornament chain 104 from mounting cap 122 or from plate 105. Ferrule 125 may be a cylindrical metal ferrule, made of, for example, steel, or aluminum, and may be crimped to the wire or rod with a conventional pliers or crimping tool.

According to one aspect, ornament cap 122 may include at least one projection or prong 124 that is adapted to engage a complementary recess, opening, or slot 126 in gallery plate 105. As shown in FIG. 6D, opening 126 may extend through a side of gallery plate 105 whereby aperture 120 comprises a discontinuous, open aperture. In one aspect, opening 126 may not extend thorough the side of gallery plate 105. According to one aspect, recess or slot 126 may be positioned anywhere about the circumference of aperture 120, including toward the front of gallery plate 105 or to the sides of aperture 120. As shown most clearly in FIG. 6D, the interaction of projection 124 and opening 126 may be adapted to position ornament chain 104 with respect to gallery plate 105 and thus position ornament chain 104 with respect to ornament chain 102. In one aspect of the invention, ornament chain 104 may be offset, or not centered, in mounting cap 122. For example, as shown in FIG. 6D, the position of ferrule 125 and ornament chain 102 may be biased toward the front of gallery plate 105. In one aspect of the invention, the biasing of the location of ornament chain 104 may be provided to enhance the desired appearance of the fixture. For example, the position of ornament chain 104 in mounting cap 122 may permit ornaments 108 to more completely fill the voids between ornaments 106 when viewed from any desired direction, for example, when viewed from an oblique angle. Though in one aspect of the invention, the location of ornament chain 104 may be biased toward the front of the gallery plate, according to other aspects of the invention, the bias direction may vary depending upon the size and type of ornaments being suspended and the desired visual effect. For example, in one aspect, the mounting of ornament chain 104 may be biased or offset toward the back of gallery plate 105 to the left or right at any desired angular rotation, as viewed in FIG. 6D.

According to one aspect of the invention, the mounting and poisoning of ornaments 106 and 108 in ornament mounting arrangement 100 may be adapted to minimize the voids visible to the observer, for example, whereby ornaments 108 are positioned substantially midway between ornaments 106, for example, as shown in the front elevation view of FIG. 6B. However, in other aspects of the invention, ornaments 108 may not be positioned substantially midway between ornaments 106. For instance, the relative elevation and lateral positioning of ornaments 106 and 108 may be affected by the intended angle at which the arrangement is to be viewed. For example, in one aspect, it may be desirable to elevate ornaments 108 relative to ornaments 106 when a light fixture having arrangement 100 is positioned above eye level and the viewer would not be viewed as shown in FIG. 6B, but from below. Similarly, in one aspect of the invention, ornament chain 104 having ornaments 108 may be laterally displaced from a position midway between the axes of ornament chains 102 to minimize or eliminate voids when a fixture is intended to be viewed from the side, for example, at an oblique angle, and not as shown in FIG. 6B.

Figure 8:
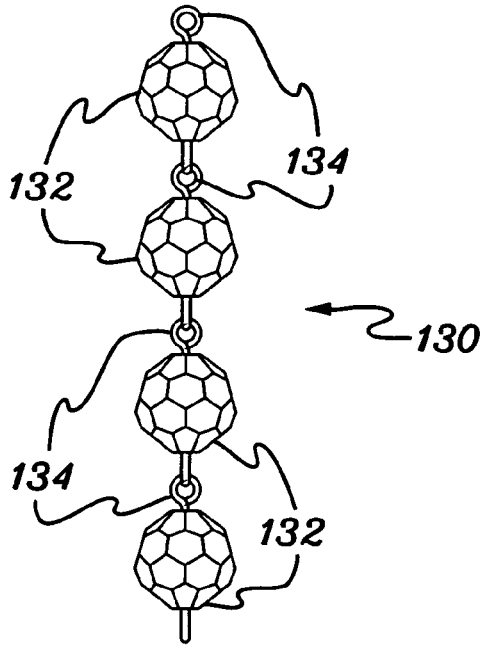
FIG. 8 is front elevation view of an alternate ornament chain that may be used for in the aspects shown in FIGS. 6A through 6D according to another aspect of the invention.

FIG. 8 is front elevation view of an alternate ornament chain 130 that may be used for ornament chain 104 shown in FIGS. 6A through 6D. Ornament chain 130 includes ornaments 132 that, though shown as faceted spheres, may comprise any type of ornament discussed above. In this aspect, ornaments 132 are suspended from wire connectors 134, for example, loop and eye-pin wire connectors. Wire connectors 134 may extend through perforations in ornaments 132 or may be substantially rigidly embedded in ornaments 132. Ornament chain 130 may be suspended from a gallery plate, for example, from gallery plate 105 by conventional means, for example, by attaching ornament chain 130 to a mounting cap 122, as discussed above. Other types of ornament chain suspending arrangements may also be used in aspects of the invention, as will be readily apparent to those of skill in the art.

Figure 9B:
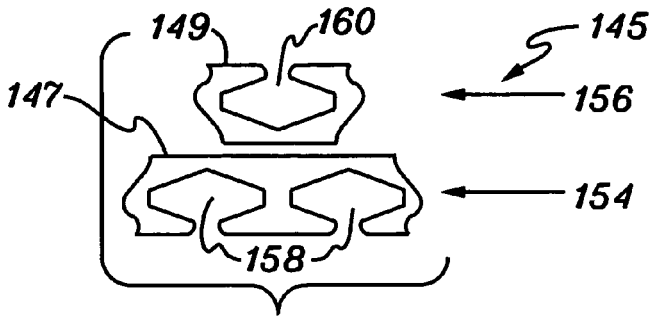
FIG. 9B is a partial plan view of a gallery plate used in the arrangement shown in FIG. 9A according to one aspect of the invention.
Figure 9A:
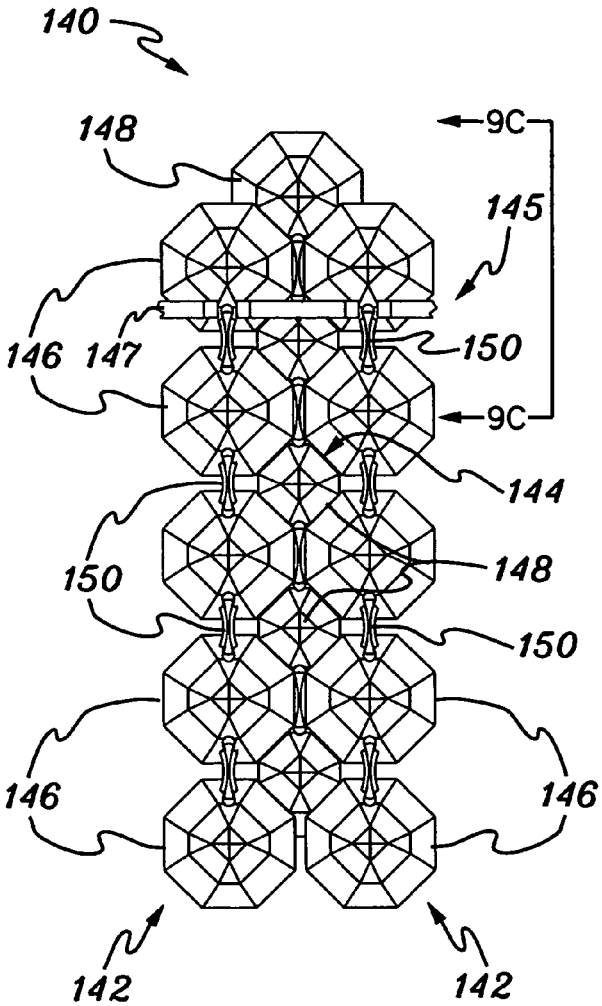
FIG. 9A is a partial front elevation view of another aspect of the invention.
Figure 9C:
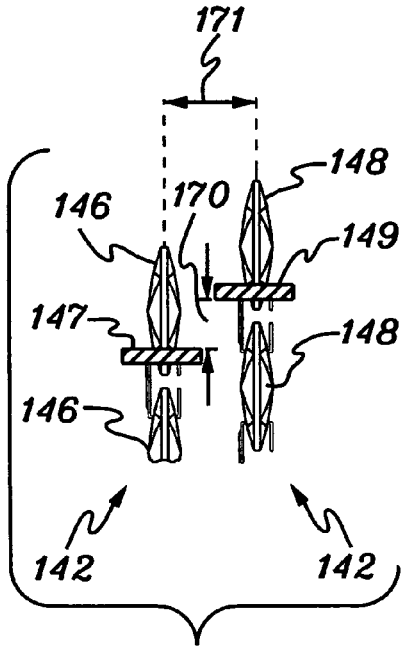
FIG. 9C is a partial side elevation view of the arrangement shown in FIG. 9A according to one aspect of the invention.

FIG. 9A is a partial front elevation view of ornament mounting arrangement 140 according to another aspect of the invention. According to this aspect of the invention, arrangement 140 includes a plurality of ornament crystal chains 142 and 144 suspended from a gallery plate 145. FIG. 9B is a partial plan view of gallery plate 145 from which ornament chains 142 and 144 may be suspended. FIG. 9C is a partial side elevation view, partially in cross-section, of arrangement 140 shown in FIG. 9A as viewed along view lines 9C—9C in FIG. 9A. Again, gallery plate 145 may be any conventional shaped plate, including a circular ring or rectangular plate, as is conventional. Gallery plate 145 may be made from one or more of the materials from which gallery plate 105 may be made. Gallery plate 145 may be fabricated by means of one or more of the fabrication methods from which gallery plate 105 may be fabricated.

According to this aspect of the invention, gallery plate 145 includes at least two tiers 147 and 149 positioned at different elevations. In a fashion similar to the aspect shown in FIG. 6A, the at least two-tiered gallery plate 145 may be adapted to support ornament chains 142 and 144 whereby little or no voids or spaces appear to the observer of the fixture, for example, a chandelier. According to one aspect, the minimization or elimination of voids is provided by positioning the elevations of tiers 147 and 149 pf gallery plate 145 whereby ornaments are substantially precisely positioned with respect to the ornaments on adjacent ornament chains. According to one aspect of the invention tiers 147 and 149 may comprise integral or separate plates or rings. For example, in one aspect, gallery plate 145 may comprise separate rings or plates comprising two or more tiers 147, 149. In another aspect of the invention, plate 145 may comprise two or more tiers 149 mounted to tier 147. Tiers 147 and 149 may be mounted by conventional means, for example, by means of welding, adhesives, or mechanical fasteners. In one aspect of the invention, tiers 147 and 149 may be attached by means of intervening structures (not shown), such as one or more pins, posts, bars, plates, rings, and the like, for example, assembled by welding or mechanical fasteners. According to one aspect of the invention, three or more, or four or more, tiers 147, 149 may be used for gallery plate 145. Gallery plate 145 may be fabricated by conventional means, for instance, cut from plate (for example, punched, milled, laser-cut, water-jet cut, EDM-cut, and the like), forged, cast, or welded, and the like.

Arrangement 140 shown in FIG. 9A illustrates only two ornament chains 142 and a single ornament chain 144 to facilitate illustration of aspects of the invention. However, typically, aspects of the invention include a plurality of ornament chains 142 and a plurality of ornament chains 144. In one aspect of the invention, ornament chains 142 and/or 144 may comprise "bead skewers," for example, as shown in FIG. 7. As shown in FIGS. 9A and 9C, ornament chains 142 and 144 include ornaments 146 and 148, respectively. According to aspects of the invention, ornament chains 142 and 144 may comprise any one of a myriad of ornaments and related ornament hardware, for example, spacers and connectors discussed above. Though in the aspect of the invention shown in FIG. 9A ornament chain 142 includes 5 ornaments 146 and ornament chain 144 includes 5 ornaments 148, in aspects of the invention, ornament chain 142 may include one or more ornaments 146, typically two or more ornaments 146, and ornament chain 144 may include one or more ornaments 148, typically two or more ornaments 148. For example, in one aspect of the invention, ornament chain 142 may include 10 or more ornaments 146 and ornament chain 144 may include 10 or more ornaments 148.

Regardless of the myriad of ornaments that may be used for the present invention, in the aspect of the invention shown in FIG. 9A, ornaments 146 and 148 both comprise conventional 14-mm octagonal glass crystals. In one aspect, ornaments 146 and 148 may comprise 14-mm octagonal glass crystals having at least two perforations, for example, at least two diametrically opposed perforations through which connecting means may be inserted. As shown, ornaments 146 and 148 may be suspended by means of a plurality of connectors 150, for example, the bow tie connectors disclosed in U.S. Pat. No. 3,629,571, though in aspects of the invention other conventional ornament connectors, such as wire connectors, may be used.

As shown in FIG. 9B, according to one aspect of the invention, gallery plate tiers 147 and 149 of gallery plate 145 may each include at least one row 154 and 156, respectively, of apertures 158 and 160 in staggered relationship. Similar to apertures 118 and 120 discussed with respect to FIGS. 6A through 6D, apertures 158 and 160 in gallery plate 145 may be adapted to support ornament chains 142 and 144. For example, as shown in FIG. 9B, apertures 158 and 160 may be "diamond shaped" to conform to the diamond-shaped cross-section of octagon ornaments 146 and 148. Apertures 158 and 160 may be shaped to be adapted to support whatever ornament shape is being supported.

As shown most clearly in FIG. 9C, gallery plate tiers 147 and 149 may be positioned at different elevations whereby they may be vertically separated by a distance 170. Distance 170 may vary depending upon the size of the ornaments being suspended, the viewing angle, and the desired visual effect, among other things. For example, in the aspect of the invention shown in FIGS. 9A through 9C, where ornament chains 142 and 144 comprise substantially identical 14-mm octagon crystals and the intention is to position ornaments 148 of chain 144 to substantially completely fill the voids between ornaments 146 of chains 142, the distance 170 will be about 14 mm, that is, about the height of the octagon crystal. According to other aspects of the invention, the distance 170 may vary from the width of the ornament being suspended. For instance, the elevation of the mounting of the fixture having arrangement 140 may impact the distance 170 and relative positioning of ornaments 146 and 148. For example, it may be desirable to elevate the location of ornaments 148 relative to ornaments 146 when a light fixture having arrangement 140 is positioned above eye level and the viewer would not be viewed as shown in FIG. 9A, but from below. Under these conditions, it may be preferable to provide a distance 170 greater than the width of the ornament whereby, when viewed from below, little or no voids are seen between ornaments 146 and 148.

As also shown in FIG. 9C, gallery plate tiers 147 and 149 may be positioned at different lateral positions whereby ornaments 146 and 148 may be laterally separated by a distance 171. Distance 171 may vary depending upon the size of the ornaments being suspended, the viewing angle, and the desired visual effect, among other things. For example, in the aspect of the invention shown in FIGS. 9A through 9C, where ornament chains 142 and 144 comprise substantially identical 14-mm octagon crystals and the intention is to position ornaments 148 of chain 144 to substantially completely fill the voids between ornaments 146 of chains 142, the distance 171 may be about 7.5 mm. According to other aspects of the invention, the distance 171 may vary, for example, from about 5 mm to about 30 mm, but may typically range from about 5 mm to about 10 mm.

Figure 10B:
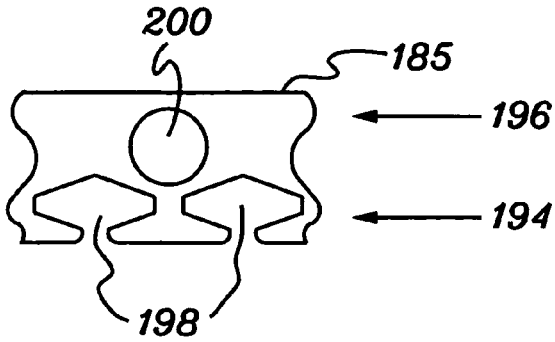
FIG. 10B is a partial plan view of a gallery plate used in the arrangement shown in FIG. 10A according to one aspect of the invention.
Figure 10A:
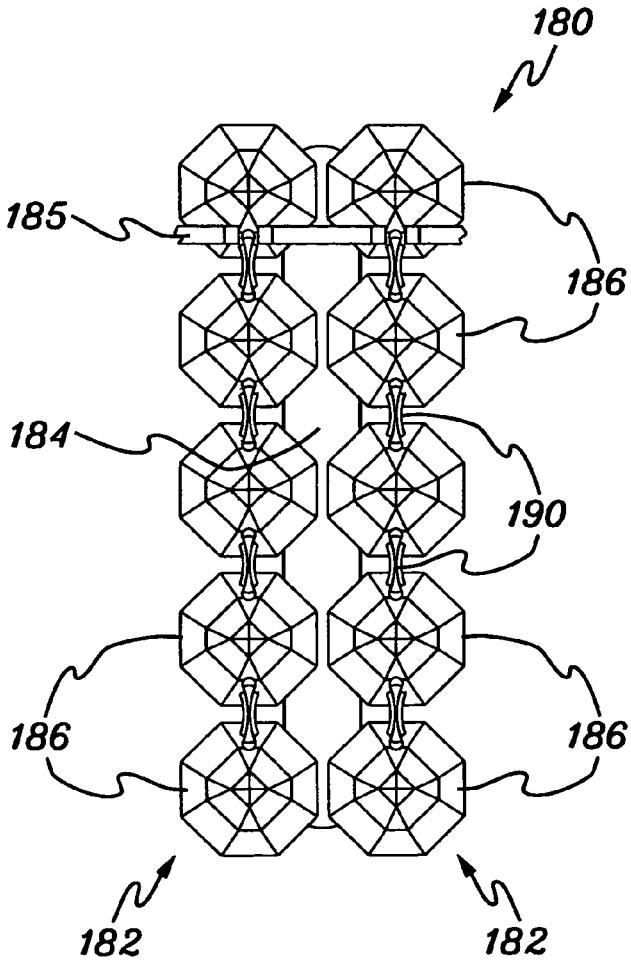
FIG. 10A is a partial front elevation view of another aspect of the invention.
Figure 11:
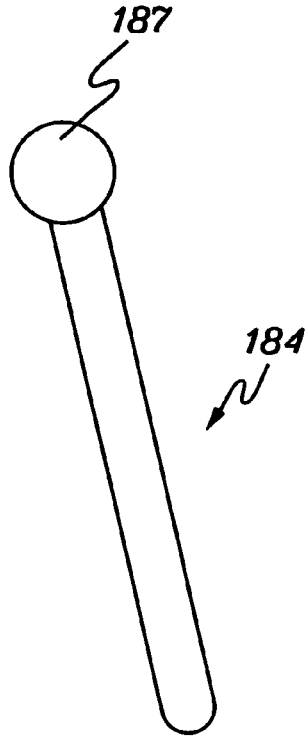
FIG. 11 is a perspective view of one glass rod 184 which may be used in arrangement 180 shown in FIG. 10A.

FIG. 10A is a partial front elevation view of another ornament mounting arrangement 180 according to another aspect of the invention. According to this aspect of the invention, arrangement 180 includes a plurality of ornament crystal chains 182 having ornaments 186 and at least one, typically, a plurality of ornamental elements 184, for example, ornaments, tubes, or rods, suspended from a gallery plate 185. FIG. 10B is a partial plan view of gallery plate 185 from which ornament chains 182 and rods 184 may be suspended. FIG. 11 is a perspective view of one glass rod 184 which may be used in arrangement 180 shown in FIG. 10A. In one aspect of the invention, rods 184 may be tubes, for example, circular cylindrical or polygonal cylindrical tubes. Gallery plate 185 may be any conventional shaped plate, including a circular ring or rectangular plate, as is conventional. Gallery plate 185 may be made from one or more of the materials from which gallery plate 105 may be made. Gallery plate 185 may be fabricated by means of one or more of the fabrication methods from which gallery plate 105 may be fabricated.

According to this aspect of the invention, gallery plate 145 includes at least two rows 194 and 196 of apertures 198 and 200, respectively, in staggered relationship. In a fashion similar to the aspect shown in FIG. 6A, gallery plate 185 is adapted to support ornament chains 182 and rods 184 whereby little or no voids or spaces appear to the observer of the fixture, for example, a chandelier. According to one aspect, the minimization or elimination of voids is provided by substantially precisely positioning the rods 184 with respect to the ornaments 186 on adjacent ornament chains 182.

Arrangement 180 shown in FIG. 10A illustrates only two ornament chains 182 and a single glass rod 184 to facilitate illustration of aspects of the invention. However, typically, aspects of the invention include a plurality of ornament chains 182 and a plurality of glass rods 184. In one aspect of the invention, ornament chains 182 may comprise "bead skewers," for example, as shown in FIG. 7. As shown in FIG. 10A, according to aspects of the invention, ornament chains 182 may comprise any one of a myriad of ornaments and related ornament hardware, for example, spacers and connectors discussed above. Though in the aspect of the invention shown in FIG. 10A ornament chain 182 includes 5 ornaments 186, aspects of the invention may include any number of ornaments 186, but typically include two or more ornaments 186.

Regardless of the myriad of ornaments that may be used for the present invention, in the aspect of the invention shown in FIG. 10A, ornaments 186 comprise conventional 14-mm octagonal glass crystals. In one aspect, ornaments 186 may comprise 14-mm octagonal glass crystals having at least two perforations, for example, at least two diametrically opposed perforations through which connecting means may be inserted. As shown, ornaments 186 may be suspended by means of a plurality of connectors 190, for example, the bow tie connectors disclosed in U.S. Pat. No. 3,629,571, though in aspects of the invention other conventional ornament connectors, such as wire connectors, may be used.

As shown in FIG. 11, glass rod 184 may comprise a cylindrical glass rod, for example, a circular cylindrical glass rod, having at least one first end 187 adapted to engage gallery plate 185. Though shown as a circular cylindrical rod, glass rod 184 may comprise any cross-sectional shape, including oval, triangular, square, rectangular, or any type of polygonal cross-sectional shape. As shown, first end 187 may comprise an enlarged, bulbous structure adapted to engage gallery plate 185; however, first end 187 may include may different types of adaptations that allow rod 184 to be mounted to gallery plate 185, including through holes, projections, and related structures, and pins and wire, and related hardware. Though rod 184 is referred to as a "glass" rod, rod or tube 184 may be made from any type of conventional metallic or non-metallic ornamental material, including plastic, ceramic, and glass.

As shown in FIG. 10B, according to one aspect of the invention, gallery plate 185 may include at least two rows 194 and 196 of apertures 198 and 200, respectively, in staggered relationship. Similar to apertures 118 and 120 discussed with respect to FIGS. 6A through 6D, apertures 198 in gallery plate 185 may be adapted to support ornament chains 182. For example, as shown in FIG. 10B, apertures 198 may be "diamond shaped" to conform to the diamond-shaped cross-section of octagon ornaments 186. In addition, aperture 200 in gallery plate 185 may be adapted to support glass rods 184. For example, as shown in FIG. 10B, apertures 200 may be circular holes adapted to support bulbous end 187 of glass rod 184. Apertures 198 and 200 may be shaped to be adapted to support whatever ornament or rod shape is being supported.

Figure 12A:
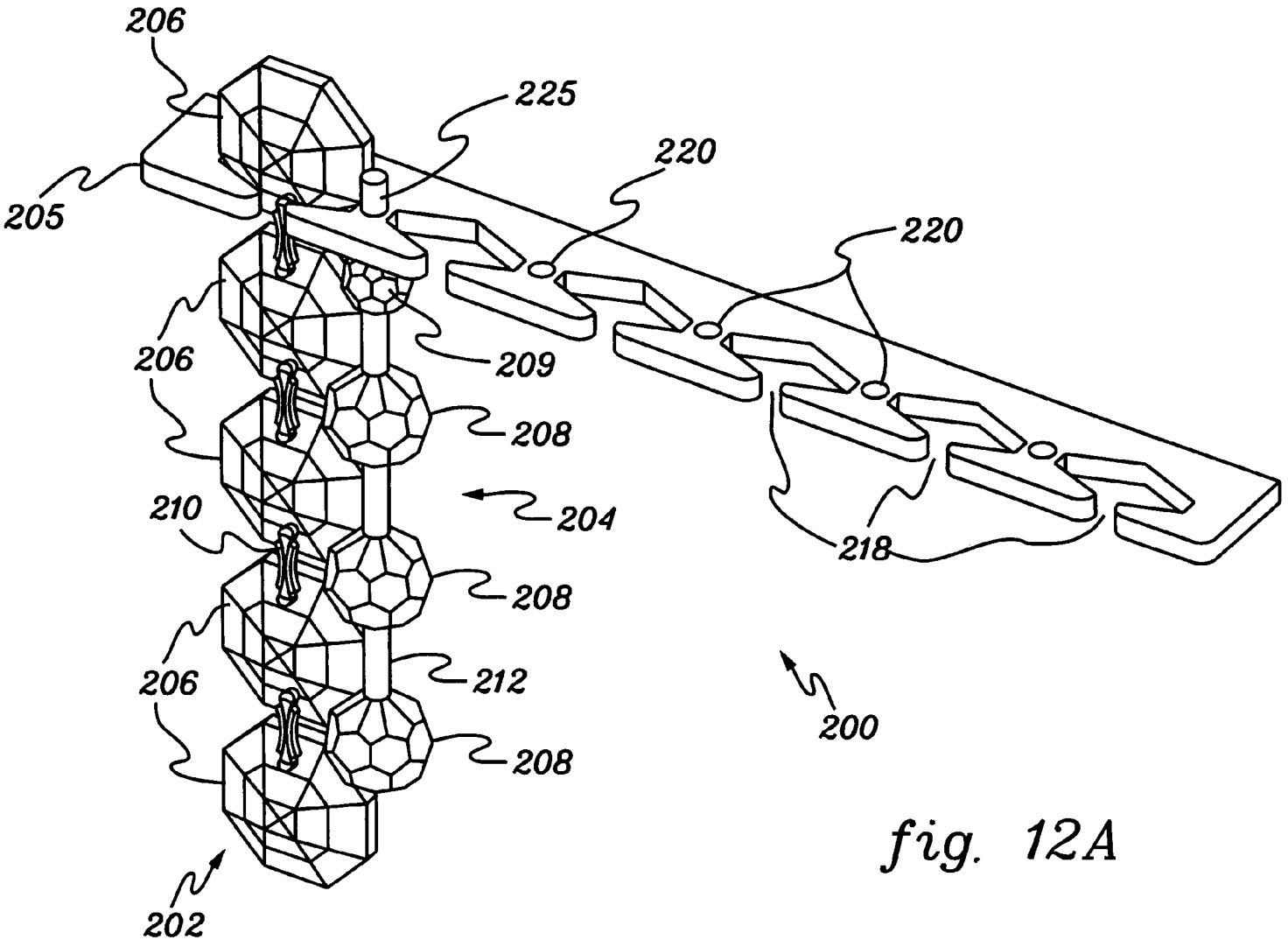
FIG. 12A is partial perspective view of an ornament arrangement according to another aspect of the present invention.
Figure 12C:
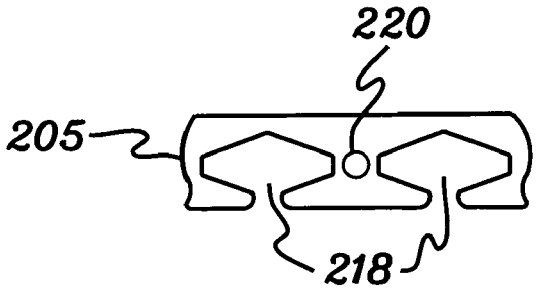
FIG. 12C is a partial plan view of a gallery plate used in the arrangement shown in FIGS. 12A and 12B according to one aspect of the invention.
Figure 12B:
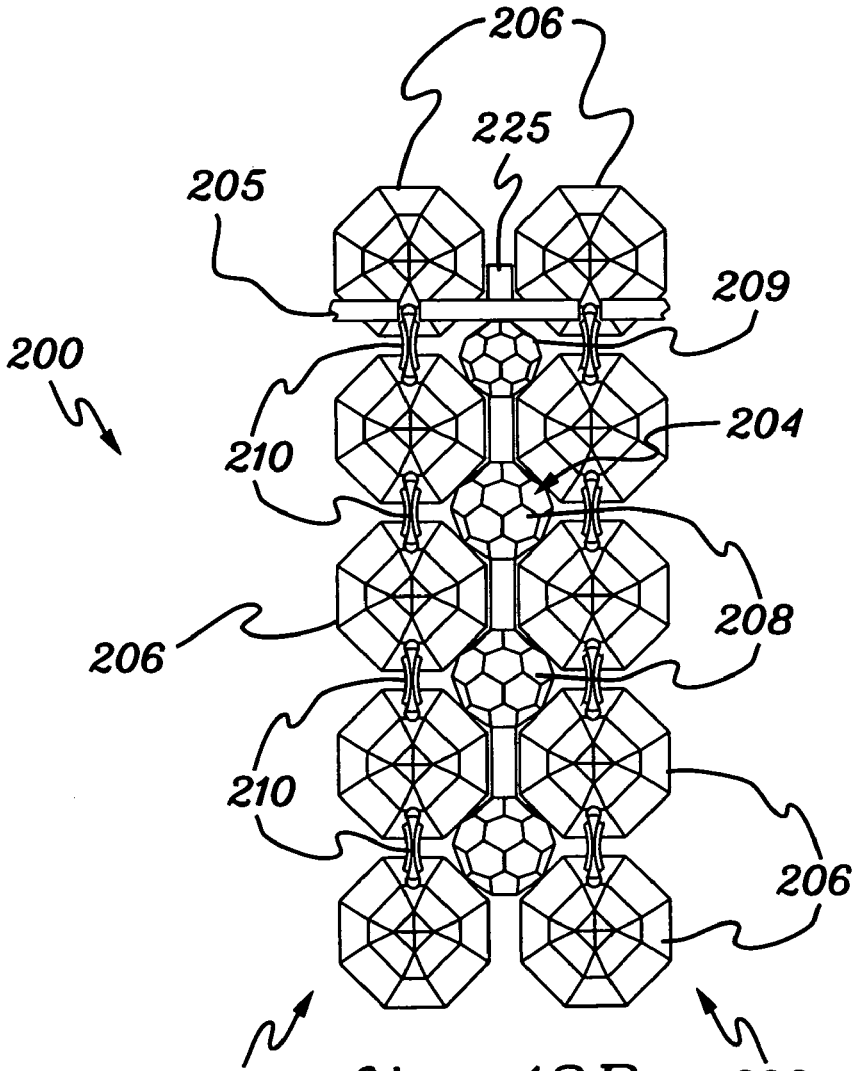
FIG. 12B is a partial front elevation view of the aspect of the invention shown in FIG. 12A according to one aspect of the invention.

FIGS. 12A, 12B, and 12C illustrate a further aspect of the invention. FIG. 12A is partial perspective view of an ornament arrangement or fixture 200 according to another aspect of the present invention. FIG. 12B is a partial front elevation view of the arrangement 200 shown in FIG. 12A. According to aspects of the invention, arrangement 200 includes a plurality of ornament crystal chains 202 and 204 suspended from a gallery plate 205. Arrangement 200 shown in FIG. 12A illustrates only a single ornament chain 202 and a single ornament chain 204 to facilitate illustration of aspects of the invention. However, typically, aspects of the invention may include a plurality of ornament chains 202 and a plurality of ornament chains 204. Ornament chains 202 may include a plurality of ornaments 206 and ornament chains 204 may include a plurality of ornaments 208. Ornaments 206 and 208 may be attached by means of connectors 210, for example, Schonbek bow tie connectors discussed previously. FIG. 12C is a partial plan view of gallery plate 205 used in the arrangement shown in FIGS. 12A and 12B.

According to one aspect of the invention, as shown in FIGS. 12A, 12B, and 12C, ornament chain 204 may be positioned substantially between adjacent ornament chains 202, for example, ornament chain 204 may be positioned in staggered relationship with ornament chains 202, as the term staggered is used above. For example, in one aspect, ornament chain 204 may be positioned substantially directly between ornament chains 202 whereby ornament chain 204 and chains 202 may be positioned substantially in the same plane, for example, the same vertical plane. It will be understood by those of skill in the art that ornament chains 204 may not be positioned exactly in the same vertical plane of ornament chains 202. For example, due to manufacturing tolerances, the relative size and shape of the ornaments, and the desired visual effect of the ornament display, among other things, ornament chains 202 and 204 may not lie in the same vertical plane. For example, ornament chains 202 may lie in front of or behind ornament chains 204. However, in one aspect, ornament chains 202 and 204 may lie substantially in the same vertical plane. According to one aspect of the invention, ornaments 206 of ornament chains 202 and ornaments 208 of ornament chain 204 may be positioned and adapted to minimize or eliminate gaps or voids in the ornament display. For instance, in one aspect, arrangement 200 provides a substantially uniform display of ornaments to the viewer, with little or no gaps or voids.

Similar to gallery plate 105 shown in and described with respect FIG. 6A, gallery plate 205 may be any conventional shaped plate, including a circular ring or rectangular plate, as is conventional. Gallery plate 205 may be metallic or non-metallic, for example, made from one or more of the metals or plastics listed above with respect to gallery plate 105. Gallery plate 205 may also be fabricated by conventional means, for instance, cut from plate (for example, punched, milled, laser-cut, water-jet cut, EDM-cut, and the like), forged, cast, or welded, and the like.

According to aspects of the invention, ornament chains 202 and 204 may comprise any one of a myriad of ornaments 206 and 208 and related ornament hardware, for example, spacers and connectors. For instance, according to aspects of the present invention, ornaments 206 and 208, and all ornaments discussed herein, may comprise any one or more of the attributes of ornaments 106 and 108 shown in and described with respect to FIG. 6A, for example, the shapes, materials, number, and colors of ornaments 106 and 108. Regardless of the myriad of ornaments that may be used for the arrangement 200, in the aspect of the invention shown in FIGS. 12A, 12B, and 12C, ornaments 206 comprise conventional 14-mm octagonal glass crystals and ornaments 208 comprise conventional spherical faceted glass beads, for example, as provided by D. Swarovski & Co., or their equivalent. In one aspect of the invention, the size of ornaments 206 and/or 208 may vary, for instance, depending upon the visual effect desired, among other things. In one aspect, due to space considerations, for example, the uppermost ornament 209 on ornament chain 204 may be smaller in size than the other ornaments 208 on chain 204. In another aspect, the size of the ornaments in ornament chains 202 and 204 may vary randomly or in a fixed pattern.

In the aspect shown in FIGS. 12A and 12B, ornaments 208 are suspended in on ornament chain 204. In one aspect, ornament chain 204 may be referred to as an ornament "bead skewer," for example, similar to ornament chain 104 shown in and described with respect to FIGS. 6A–6D, 7A, and 7B. In one aspect, ornament chain 204 may be oriented in a vertical direction, for example, suspended from gallery ring 205 from above. In one aspect of the invention, ornaments 208 may include through holes, for example, through holes passing through the center of the ornament 208, through which a wire or rod (not shown) may pass to engage the plurality of ornaments 208 and from which ornament chain 204 may be suspended, for example, suspended from gallery plate 205. In the aspect of the invention shown in FIGS. 12A and 12B, ornament chain 204 may also include one or more ornament spacers 212. In this aspect of the invention, spacers 212 may comprise small tubes, for example, small metallic or non-metallic tubes, through which the wire or rod which mounts ornaments 208 to chain 204 passes. In one aspect, spacers 212 locate ornaments 208 on ornament chain 204 whereby, when suspended, ornaments 208 are positioned, for example, precisely positioned, at elevations between ornaments 206 on ornament chain 202, for example, substantially midway between adjacent ornaments 206 on ornament chain 202, as shown in FIG. 12B. In one aspect of the invention, ornaments 208 may be positioned on chains 204 whereby ornaments 208 are located at an elevation anywhere between adjacent ornaments 206. In another aspect of the invention, the lower-most ornament 208 in ornament chain 204 may be suspended from the wire or rod (not shown) passing through ornaments 208 by a conventional obstruction, for example, a flared or crimped ferrule attached to the wire or rod.

As shown in FIGS. 12A and 12B, ornament chains 202 and 204 may be suspended from gallery plate 205. In one aspect of the invention, gallery plate 205 may be adapted by any means to support ornament chains 202 and 204, for example, for supporting ornament chains 202 and 204 in staggered relationship with each other, as discussed with respect to ornaments 102 and 104 above. In one aspect of the invention, when viewed in a front elevation view, for example, as in FIG. 12B, ornaments 208 of ornament chain 204 sufficiently fill the space between ornaments 206 on ornament chain 202 whereby little or no space is visible between ornaments, for example, whereby substantially no internal components of the fixture can be seen.

According to one aspect of the invention, ornament chains 202 and 204 may be suspended from gallery plate 205 by any conventional means, for example, by means of mechanical fasteners or welding. As shown most clearly in FIGS. 12A and 12C, according to one aspect of the invention, gallery plate 205 may include at least two sets of apertures 218 and 220 adapted for suspending ornament chains 202 and 204. As shown in FIG. 12A, apertures 220 may be positioned substantially between apertures 220. According to aspects of the invention, apertures 218 and 220 in gallery plate 205 may be adapted to support ornament chains 202 and 204. For instance, at least one of apertures 218 and 220 may be adapted to retain an ornament 206 or an ornament 208. For example, as shown in FIG. 12C, apertures 218 may be shaped to conform to the shape of the ornament being supported, specifically, aperture 218 may be "diamond shaped" to conform to the diamond-shaped cross-section of octagon ornament 206. Similarly, aperture 218 may be circular in shape to conform to the shape of the spherical bead ornament 208. In addition, apertures 220 in gallery plate 205 may be similarly shaped to conform to the shape of the ornament being supported. In another aspect of the invention, ornament chains 202 and 204 may be suspended from gallery plate 205 by means of a mounting cap, for example, a mounting cap similar to mounting cap 122 shown in and described with respect to FIGS. 6A–6D, 7A, and 7B.

In one aspect of the invention, ornament chains 202 and 204 may be suspended from gallery plate 205 by one or more mechanical fasteners. For example, as shown in FIGS. 12A–12C, ornament chain 204 may comprise a wire or rod (not shown) onto which ornaments 208 and spacers 212 are mounted. In one aspect of the invention, the wire or rod of ornament chain 204 may be attached to gallery plate 205 by conventional means, for example, by welding or mechanical fasteners. In the aspect shown in FIGS. 12A–12C, ornament chain 204 is mounted to gallery plate 205 by passing the wire or rod of ornament chain 204 through aperture 220 and attaching the wire or rod to aperture 220. For example, the wire or rod may be suspended from aperture 220 by means of an obstruction mounted to the wire or rod, for example, a ferule 225, which contacts the upper surface of gallery plate 205. The ferrule 225 or other obstruction may be mounted, for example, by crimping ferrule 225 to the wire or rod. Other means of attaching a wire or rod to galley plate 205 to suspend ornament chain 204 will be apparent to those of skill in the art.

The aspects of the invention shown and described with respect to FIGS. 1 through 12C provide improved methods and devices for mounting and displaying decorative ornaments, for example, in ornamental fixtures, such as chandeliers. Among the numerous advantages, aspects of the invention provide for the use of chains of similar or dissimilar ornaments to be displayed, for example, as a "curtain" of ornaments, whereby little or no undesirable gaps or voids are visible to the observer. Aspects of the invention also limit or avoid the appearance of gaps or voids in the curtain even when viewed at oblique angles, for example, from below or from the side. In addition to limiting the visible gaps and voids in the ornamental presentation, aspects of the invention, also limit or eliminate the undesirable view of fixture support structure, for example, the internal metal work that supports and positions the ornaments, that heretofore was not available in the art.

Aspects of the present invention also advance the capabilities of the ornamental fixture designer. Specifically, aspects of the invention provide the designer with the unique opportunity to combine and contrast color in fixtures having ornamental crystals. Crystal ornaments, for example, multi-faceted crystal beads available from the jewelry industry, are available in a wide palette of colors. Aspects of the present invention, for example, those shown in FIGS. 6B, 9A, 10A, and 12B allow designers to combine and contrast ornaments of different colors, for example, sapphire blue multi-faced spheres with amethyst octagonal crystals, to provide an interplay of ornament color that heretofore was unavailable. The overlapping and juxtapositioning of adjacent colored ornaments (or with non-colored ornaments) provides new creative dimensions for mixing color and creating composite blends, for example, based upon the refraction of light through overlapping ornaments of different hues. Aspects of the invention not only minimize voids (or enhance the density) of ornamental arrangements, but aspects of the invention, also provide for a much more interesting and dynamic use of color in the design of crystal fixtures, such as chandeliers, than has ever been possible before.

While several aspects of the present invention have been described and depicted herein, alternative aspects may be affected by those skilled in the art to accomplish the same objectives. Accordingly, it is intended by the appended claims to cover all such alternative aspects as fall within the true spirit and scope of the invention.

The invention claimed is:

1. A method of mounting ornaments, the method comprising:

suspending a plurality of ornament chains in a first vertical plane, the ornament chains comprising a plurality of spaced first ornamental elements; and suspending at least one second ornamental element in a second vertical plane, laterally spaced from the first vertical plane, wherein the at least one second ornamental element is positioned in staggered relationship with the ornament chains;

wherein the first ornamental elements comprise ornaments having a first hue, and the at least one second ornamental element comprises at least one ornamental element having a second hue, different from the first hue, and wherein the method further comprises, when the at least one second ornamental element is positioned in staggered relationship with the ornament chains, blending at least some of the first hue with the second hue.

2. The method as recited in claim 1, wherein the at least one second ornamental element comprises at least one of an individual element and an ornament chain comprising a plurality of ornaments.

3. The method as recited in claim 2, wherein the at least one individual element comprises one of a crystal, a tube, and a rod.

4. The method as recited in claim 1, wherein the method further comprises:

providing at least one support structure, and wherein suspending the plurality of ornament chains comprises suspending the plurality of ornament chains from the at least one support structure; and wherein suspending the at least one second ornamental element comprises suspending the at least one second ornamental element from the at least one support structure.

5. The method as recited in claim 1, wherein the plurality of ornament chains comprise a plurality of first ornament chains comprising a plurality of first ornaments; and wherein the at least one second ornamental element comprises a plurality of second ornament chains comprising a plurality of second ornaments.

6. The method as recited in claim 5, wherein the method further comprises positioning the plurality of second ornaments at different elevations than the plurality of first ornaments.

7. The method as recited in claim 6, wherein positioning the plurality of second ornaments at different elevations than the plurality of first ornaments comprises positioning the plurality of second elements at elevations between the plurality of first ornaments.

8. The method as recited in claim 7, wherein positioning the plurality of second elements at elevations between the plurality of first ornaments comprises positioning the plurality of second ornaments at elevations substantially midway between the first ornaments.

9. The method as recited in claim 5, wherein the plurality of first ornament chains comprise a first set of axes and the plurality of second ornament chains comprise a second set of axes, and wherein suspending in staggered relationship comprises suspending the plurality of second ornament chains whereby, in a front elevation view, the second set of axes is at least partially offset from the first set of axes.

10. The method as recited in claim 1, wherein the plurality of ornament chains comprise a plurality of first ornaments having voids there between, and wherein the method further comprises positioning the at least one second ornamental element to at least partially obstruct the voids.

11. An ornament arrangement comprising:

at least one support structure adapted to support a plurality of ornamental elements;

a plurality of ornament chains comprising a plurality of first ornamental elements, the first ornament chains mounted to the at least one support structure in a first vertical plane; and at least one second ornamental element mounted to the at least one support structure in a second vertical plane, laterally spaced from the first vertical plane, and positioned in staggered relationship with the plurality of first ornament chains;

wherein the first ornamental elements comprise ornaments having a first hue, and the at least one second ornamental element comprises at least one ornamental element having a second hue, different from the first hue, and wherein the staggered relationship of the at least one second ornamental element with the plurality of first ornament chains provides at least some blending of the first hue with the second hue.

12. The arrangement as recited in claim 11, wherein the at least one second ornamental element comprises at least one of an individual ornament and an ornament chain comprising a plurality of ornaments.

13. The arrangement as recited in claim 12, wherein the at least one individual ornament comprises at least one of a crystal, a tube, and a rod.

14. The arrangement as recited in claim 11, wherein the plurality of ornament chains comprises a plurality of first ornament chains comprising the plurality of first ornaments;

and wherein the at least one ornamental element comprises a plurality of second ornament chains comprising a plurality of second ornaments.

15. The arrangement as recited in claim 14, wherein, in a front elevation view, the plurality of second ornaments is positioned at different elevations than the plurality of first ornaments.

16. The arrangement as recited in claim 14, wherein the plurality of second ornaments is positioned at elevations between the plurality of first ornaments.

17. The arrangement as recited in claim 14, wherein the plurality of second ornaments is positioned at elevations substantially midway between the first ornaments.

18. The ornament arrangement as recited in claim 14, wherein the plurality of first ornament chains comprise a first set of axes and the plurality of second ornament chains comprise a second set of axes, and wherein staggered relationship comprises suspending the plurality of second ornament chains whereby the second set of axes is at least partially offset from the first set of axes.

19. The arrangement as recited in claim 11, wherein the plurality of ornament elements comprise voids between the elements, and wherein the at least one second ornamental element at least partially obstructs the voids.

20. A support structure for supporting ornaments, the support structure comprising:

a plate;

a plurality of first apertures in the plate, the first apertures positioned in spaced relationship and defining a first vertical plane, and the first apertures adapted to support a plurality of first ornaments; and a plurality of second apertures in the plate, the second apertures positioned in spaced relationship and defining a second vertical plane, laterally spaced from the first vertical plane, the second apertures positioned in staggered relationship with the first apertures, and the second apertures adapted to support a plurality of second ornaments in staggered relationship with the plurality of first ornaments.

21. The support structure as recited in claim 20, wherein the plate comprises at least two tier plates, and the plurality of first apertures are positioned in a first tier plate and the plurality of second apertures are positioned in a second tier plate.

22. The support structure as recited in claim 21, wherein the second tier plate is vertically spaced from the first tier plate.

23. The support structure as recited in claim 20, wherein the first vertical plane comprises one of a linear plane and a curvilinear plane.

24. An ornament arrangement comprising:

an elongated support element;

a plurality of ornaments mounted to the support element;

a plurality of spacers mounted to the support element between the plurality of ornaments; and means for mounting the ornamental arrangement to a support structure wherein the ornament arrangement suspends vertically from the support structure;

wherein the means for mounting the ornamental arrangement to a support structure comprises a mounting cap to which the support element is mounted, and wherein the mounting cap comprises means for orientating the arrangement in a predetermined orientation.

25. The arrangement as recited in claim 24, wherein the support element comprises one of a wire and a rod.

26. The arrangement as recited in claim 24, wherein the plurality of ornaments comprise at least one perforation, and wherein the support element passes through the at least one perforation of each of the plurality of ornaments.

27. The arrangement as recited in claim 24, wherein the mounting cap comprises a disk and wherein the means for orienting the ornament chain comprises at the least one radial projection from the disk adapted to engage a recess in the support structure.

28. The arrangement recited in claim 27, wherein the plurality of ornaments are mounted to the disk at predetermined position relative to the at least one radial projection.

29. The ornament chain as recited in claim 24 wherein the ornament chain comprises an ornament skewer.

30. A method of mounting ornaments, the method comprising:

suspending a plurality of first ornament chains comprising a plurality of first ornaments having a first nominal size in a vertical plane, the plurality of first ornaments positioned in spaced relationship; and suspending a plurality of second ornament chains comprising a plurality of second ornaments having a second nominal size, different from the first nominal size, in substantially the same vertical plane, and wherein the plurality of second ornament chains are positioned in staggered relationship with the first ornament chains.

31. The method as recited in claim 30, wherein the second nominal size is less than the first nominal size.

32. The method as recited in claim 30, wherein the method further comprises positioning the plurality of second ornaments at different elevations than the plurality of first ornaments.

33. The method as recited in claim 32, wherein positioning the plurality of second ornaments at different elevations than the plurality of first ornaments comprises positioning the plurality of second elements at elevations between the plurality of first ornaments.

34. The method as recited in claim 33, wherein positioning the plurality of second elements at elevations between the plurality of first ornaments comprises positioning the plurality of second ornaments at elevations substantially midway between the first ornaments.

35. The method as recited in claim 30, wherein the plurality of first ornament chains comprise a first set of axes and the plurality of second ornament chains comprise a second set of axes, and suspending in staggered relationship comprises suspending the plurality of second ornament chains whereby the second set of axes is at least partially offset from the first set of axes.

36. The method as recited in claim 30, wherein the plurality of first ornaments comprise voids there between, and wherein the method further comprises positioning the plurality of second ornaments to at least partially obstruct the voids.

37. An ornament arrangement comprising:

at least one support structure adapted to support a plurality of ornamental elements;

a plurality of ornament chains comprising a plurality of first ornaments having a first nominal size and positioned in spaced relationship, the plurality of first ornament chains mounted to the at least one support structure in a vertical plane; and a plurality of second ornament chains comprising a plurality of second ornaments having a second nominal size, different tom the first nominal size, the plurality of second ornament chains positioned in staggered relationship with the first ornament chains and mounted to the at least one support structure in substantially the same vertical plane.

38. The arrangement as recited in claim 37, wherein the second nominal size is less than the first nominal size.

39. The arrangement as recited in claim 38, wherein the plurality of second ornaments is positioned at different elevations than the plurality of first ornaments.

40. The arrangement as recited in claim 38, wherein the plurality of second ornaments is positioned at elevations between the plurality of first ornaments.

41. The arrangement as recited in claim 38, wherein the plurality of second ornaments is positioned at elevations substantially midway between the first ornaments.

42. The arrangement as recited in claim 38, wherein the plurality of first ornament chains comprise a first set of axes and the plurality of second ornament chains comprise a second set of axes, and wherein staggered relationship comprises positioning the plurality of second ornament chains whereby the second set of axes is at least partially offset from the first set of axes.

43. The arrangement as recited in claim 38, wherein the plurality of first ornament chains comprise a plurality of voids between the first ornaments, and wherein the second ornaments at least partially obstruct the voids.

44. The method as recited in claim 1, wherein at least one of the first hue and the second hue is non-colored.

45. The arrangement as recited in claim 11, wherein at least one of the first hue and the second hue is non-colored.

46. The method as recited in claim 1, wherein the first ornamental elements comprise ornamental glass crystals.

47. The arrangement as recited in claim 11, wherein the first ornamental elements comprise ornamental glass crystals.

* * * * *

UNITED STATES PATENT AND TRADEMARK OFFICE

CERTIFICATE OF CORRECTION

PATENT NO. : 7,225,851 B2
APPLICATION NO. : 11/036864
DATED : June 5, 2007
INVENTOR(S) : Schonbek et al.

It is certified that error appears in the above-identified patent and that said Letters Patent is hereby corrected as shown below:

In The Claims:

Claim 37, col. 20, line 63: delete "different tom the first nominal size," and insert -- different from the first nominal size, --

Signed and Sealed this

Seventh Day of August, 2007

JON W. DUDAS
*Director of the United States Patent and Trademark Office*